United States Patent [19]

Vulcano

[11] Patent Number: 4,884,735

[45] Date of Patent: Dec. 5, 1989

[54] APPARATUS FOR INSTALLING STRIPPING MATERIAL TO A WALL AT A UNIFORM DISTANCE ABOVE A FLOOR

[76] Inventor: Vincent Vulcano, 301 East 48th St., Apt 11G, New York, N.Y. 10017

[21] Appl. No.: 236,460

[22] Filed: Aug. 26, 1988

[51] Int. Cl.[4] ..... B27F 7/02

[52] U.S. Cl. ..... 227/111; 227/156

[58] Field of Search ..... 227/110, 111, 156

[56] References Cited

U.S. PATENT DOCUMENTS 3,771,708 11/1973 DeNicoto et al. ..... 227/111

4,225,074 9/1980 Jacobson ..... 227/111

*Primary Examiner*—Paul A. Bell

*Attorney, Agent, or Firm*—Stephen E. Feldman

[57] ABSTRACT

Apparatus for securing cap type material to a wall at a uniform distance above a floor includes a base composed of a slider and an angularly disposed shoulder. The slider is in the form of a plate that permits the base to be slid along the floor. The shoulder permits the base to be slid along the wall. The shoulder includes a top, a roller biased and pressing against the top, a port through the shoulder and a mounting for supporting a nailer or other strip material fastening means on the base and positioned for securing the strip of material to the wall through the port in the shoulder. The cap type material is positioned at a uniform distance above the floor by passing the apparatus along the floor at the wall while the cap type material rides on the top of the shoulder and under the roller.

28 Claims, 3 Drawing Sheets

APPARATUS FOR INSTALLING STRIPING MATERIAL TO A WALL AT AN UNIFORM DISTANCE ABOVE A FLOOR

BACKGROUND OF THE INVENTION

1. Field of the Invention

The present invention relates to appliances used for room decoration. In particular, the present invention is an appliance useful in placing floor covering and/or carpeting along the bottom edge of a wall of a room in a residence or the floor of commercial space.

2. History of the Invention

With the increase of fuel costs different efforts have been made to reduce the costs of heating buildings. This is especially true in buildings used for residence purposes and in buildings used for commercial space, such as office space. One approach is to increase the insulation placed in the walls and ceilings and to use materials with more and/or improved insulation characteristics.

It has been found that carpeting, used as a floor covering, has both insulation and beauty characteristics. The insulation characteristics are both against heat and/or cold transfer and sound transfer.

In many houses and in fine hotels the walls of the rooms are generally finished at the floor line by a wood base board, and carpeting is most often run up against or under this base board. The wood base board serves several purposes. One of these purposes is to protect the wall at the base of the wall.

In cheaper hotels, motels and in commercial space, the wood base board is most often eleminated and a strip of carpeting is placed against the wall to protect the wall at its base. The top edge of this strip of carpeting is capped with a capping strip. This capping strip has a small hood on its upper edge which captures and holds the edge of the carpeting and both holds the carpeting in place and finishes off the edge of the carpeting.

The capping strip, which may be considered a molding, is secured to the wall prior to placing carpeting against the wall and under the cap of the strip material. The use of a capping strip finishes off the floor covering and provides an easy way of removing the carpeting when replacement is necessary.

However in installing the strip of floor carpeting, the edges of the carpeting are cut straight and the strip cap is installed on the wall at an uniform distance or height above the floor. The problem of cutting the carpeting is solved in any of several different ways however, installation of the capping strip on the wall at an uniform height or distance above the floor presented problems.

One method of installation of the capping strip on the wall is to mark a line on the wall as a guide and secure the strip cap on the wall according to the mark on the wall.

When using a mark on the wall, the mark may be made either with a chalk line or snap line or by using a series of height marks and join the height marks into a solid line along the wall.

The use of a chalk line or snap line is quick, convenient and provides a straight line. The problem of using a chalk line arises when the floor is not level. If the floor is not level, such as the floor sinking or rising between corners of the room, the chalk line although straight will not be at an uniform height above the floor. Another problem is the use of the line itself on the wall. When using a wall line as a guide to install the strip cap, since the strip cap is a length of material, one must install the strip over the line or under the line. Installing the strip cap over the line makes a straight installation very difficult since one can not lay a strip material over a line, and still see the line. If the strip material is installed on the wall under the line then a visible mark on the wall remains after installation of the strip.

THE PRESENT INVENTION

The present invention over comes the problems attendent installation of capping strip or strip of capping on a wall at an uniform distance above the floor, for capturing the edge of a strip of carpeting placed against the lower base of a wall. The present invention may be referred to as a strip capping or a capping strip installation apparatus since use of the appliance makes possible installation of a strip of capping material on a wall at an uniform height above the floor without the need of pre-marking the wall.

The invention includes a base formed by a flat runner or slide and an extending upright shoulder which is contoured at an angle, substantially the same angle as the angle between the floor and the wall. This angle is normally a right angle of ninety (90°) degrees. The base may be fixed at an established angle approximating the angle between the floor and the wall or may be at 90° or may be adjustable with respect to the angle. The runner may be a rollerless slider, which, may be slid along the floor or may have rollers or wheels. The runner extends upright into a shoulder, the exterior of which forms the desired angle. The shoulder has a top that extends above the bottom of the slider a constant distance.

An arm is mounted on the inside of the shoulder and holds a roller biased against the top of the shoulder. In use, the slider is placed on the floor with the shoulder against the wall. This places the outside angle of the base in the angle formed by the junction of the wall and the floor. The capping strip is positioned so that the cap or hood of the capping strip lies on the top of the shoulder with the skirt of the capping strip extending downward, toward the floor, between the wall and the outside face of the shoulder, with the cap or hood, under the roller, pressed against the top of the shoulder.

The slider is sufficiently short in length so as to slide along the floor, against the wall, and essentially follow the contour of the floor at the junction of the wall and floor. As the capping strip installation device is moved along the floor at the junction of the wall and floor a strip of capping material may be positioned against the wall along the top of the shoulder and particularly under the biased roller. The strip of capping material may be secured to the wall at intervals, as the installation device progresses along the floor. This ensures that the strip of capping material is secured to the wall at a constant height above the floor along the entire wall. Premarking the wall is avoided and uniformity of height above the floor for the capping strip is attained.

In order to secure the capping strip to the wall a nailer or stapling device or gun may be used. A nail or nailing device may be mounted on an upright extending mounting attached to the inside face of the shoulder. An access hole or port in the shoulder permits a nail to be driven into the skirt of the capping material strip so as to secure the strip to the wall.

Preferably, the nail machine is an automatic nailer, which may be an off-the-shelf device adapted to be installed on the nailer mounting attached to the shoulder so that the nailer drives nails through the port in the shoulder and into the skirt of the capping strip so as to secure the capping strip to the wall.

Although preferable the base is a fixed, rollerless component with a slider and shoulder fixed at 90°, the slider and shoulder may be made as separate, hinged components with a locking device so that the angle between the slider and shoulder is adjustable. Also, the base may include castors or rollers so that the slider or base may be rolled along the floor by the operator.

The roller at the top of the shoulder is biased so that as the appliance passes along the stripe of capping material the roller, which rolls along the top of the cap of the capping strip , holds the capping strip firmly against the top of the shoulder. The nailer and nailing port in the wall of the shoulder are positioned close to the roller and upstream along the capping strip. After the first nail is driven into the skirt of the capping strip then the capping strip is held by nail or nails driven into the capping strip and wall on one side of the nailer and by the roller on the other side of the nailer. The need for a second roller, on the upstream side of the capping strip is avoided, although a second roller may be used, if desired. Once the capping strip is in place on the wall, the strip of carpeting is placed or forced into place between the capping strip and the floor. The carpet strip may be held in place against the wall by means of an adhesive or by nailing or stapling the carpeting strip to the wall or the strip of carpeting may be an extension of the carpeting laid on the floor.

DETAILED DESCRIPTION OF THE INVENTION

Figure 1:
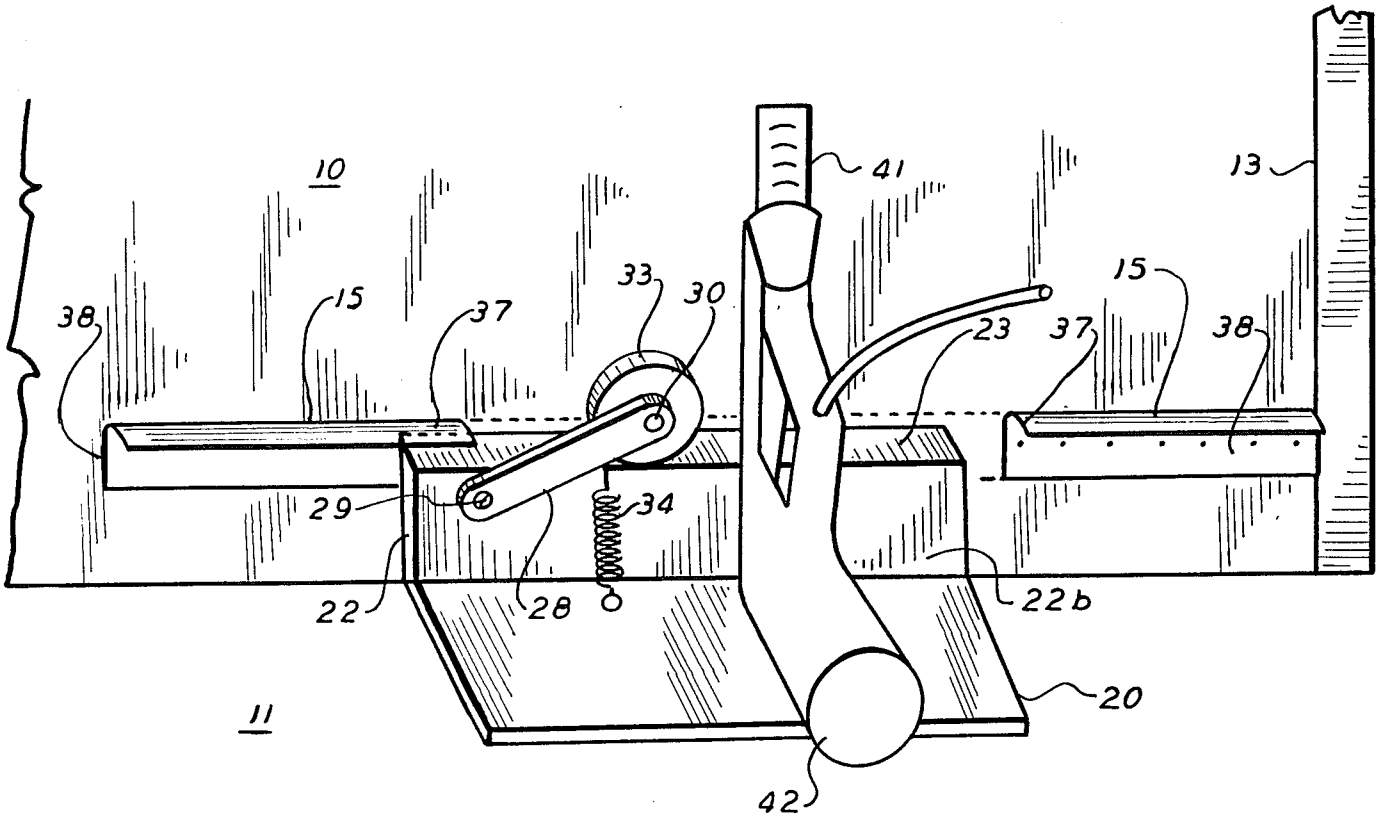
FIG. 1 is a representation, in perspective view, of the present invention in use installing a capping strip on a wall, as viewed from inside a room.

Referring to the drawings in general, throughout the various drawings identical elements or components will be identified by identical call-out numbers.

In the FIGS. there is shown in pictorial perspective a representation of a wall 10 and floor 11.

The wall, at its opening or doorway is terminated with a vertically running molding 13 or door frame around the opening.

The present invention, a cap strip installing device, is positioned along a part of the wall at the junction of the wall and floor. This junction usually approximates a right angle, the floor being generally a horizontal plane and the wall being generally a vertical plane, both the wall and the floor at normal, with respect to each other.

The primary purpose of the invention is to install a cap strip 15 on the wall 10 at an uniform height or distance above the floor 11. This may be accomplished without pre-marking the wall to establish the height at which the strip material is to be secured to the wall.

The invention includes a base comprising a slider or runner 20, which is essentially a flat plate which may be slid across the floor. Extending upwardly from the runner 20 is a shoulder 22. The junction of the slider and shoulder forms an angle, preferrable approximating or the same as the angle formed by the wall and floor, at the junction thereof. The shoulder 22 has a top surface 23, which extends across, the top of the shoulder at a uniform height above the bottom of the slider 20. The wall **22*a* of the shoulder 22 has a port or hole 25, more clearly seen in FIG. 2**, the ends of which are flush with the surface of the shoulder wall.

Pivotally mounted on the inside of the shoulder 22 is an arm 28. This arm is mounted on a pin 29 extending from the shoulder 22. The other end of arm 28 supports a pin 30 which extends from the arm and over top of the shoulder 23. The pin 30 supports a rotating wheel or roller 33. The arm 28 is bias by a spring 34 which holds the roller 33 against the top of the shoulder 23.

The purpose of the slider is to lie on the floor and slide along the floor, as moved by an operator of the device. The purpose of the shoulder is to position the device against the wall, as positioned by the operator. The top of the shoulder supports the capped strip material where the hood or cap extends over and rests on the top of the shoulder, the roller being positioned on the top or upper portion of the hood, holding the hood against the top of the shoulder.

The hood or cap 37 of the capped strip material 15 is positioned in the space between the roller 33 and the top of the shoulder 23 while the skirt 38 extends downward along the wall 10 so that the strip 15 may be nailed or otherwise secured to the wall.

As stated above, the preferred embodiment, as represented herein includes a nailer or, nailing device or stapler which may be used to secure the strip of capped material to the wall. The nailer may be replaced by other securing devices such as sonic welders or any device which may be used to secure the capping strip to the wall.

Figure 4:
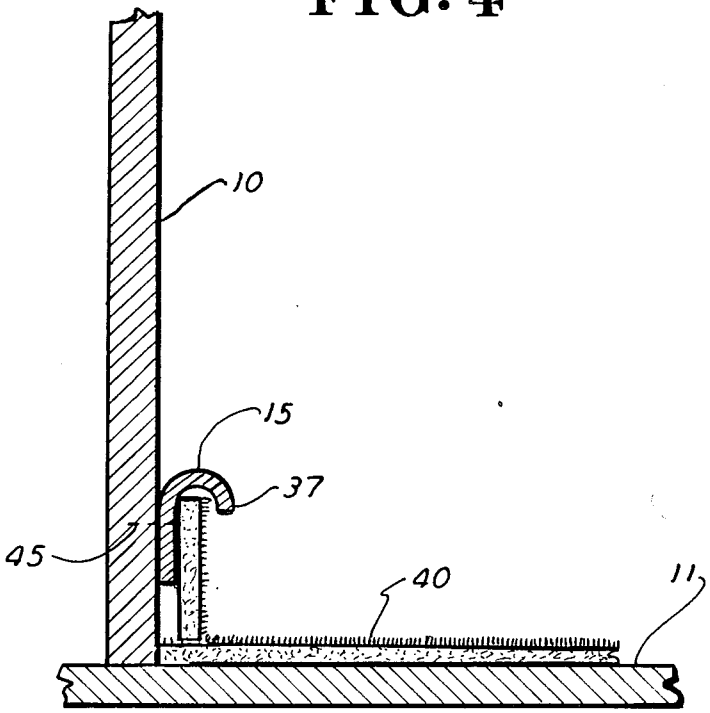
FIG. 4 is a cross sectional view of a wall/floor junction with a carpet running up the wall, with the edge thereof captured in the hood of a capping strip.

The capping strip is preferably of a plastic material but it could be metal or any combination of materials. The hood or cap 37 of the capping strip 15 is designed to capture, retain and cover the edge of the carpeting 40 that is placed against the wall or placed on the floor and has the edge thereof run up the wall, as illustrated in FIG. 4.

Attached to the inside face **22*b* of the shoulder 22 is a mounting 41 on which a nailer 42 is mounted. The nailer is preferably an electrically operated device which is trigger operated and drives a nail out of the nose of the device, through the port 25 and into the skirt 38 of the capping strip 15. The nails 45 so driven may pass through the skirt 38 of the capping material and enter the wall 10, securing the strip 15** to the wall in a well known manner.

Although the present invention has been described relative to its use, for installing a strip of capping material for a carpet edging, the invention may be used for installing other types of strip or edging where it is desirable to install the strip of material at an uniform distance from an adjacent surface or edge, either real or fabricated. The two adjacent real surfaces may be floor and wall or wall and wall or ceiling and wall, for example. An adjacent surface may be fabricated by setting one surface, such as a door, for example on a table, a second surface, for example, so the surface of the door is at normal to the surface of the table.

In an alternate structure a gluing device may be substituted for a nailer. The substitute gluing device may be of the type that is designed to deliver or lay a bead of adhesive at the junction between the cap 37 and skirt 38 and the wall so as to adhere the capping strip to the wall.

In a further alternate structure the shoulder 22 may be in the form of a frame or some adjustable construction as opposed to a solid construction, as represented. The shoulder could be adjustable so that the height of both or either the top of the shoulder and/or the height of the port 25 above the floor may be adjusted thus making the height of installation of the strip adjustable.

In a still further alternate structure the depth of the port 25 may extend lower down the face of the shoulder and the mounting of the nailer on the mounting rail 41 may be adjustable so that the elevation of the nailer is adjustable and nails may be driven into the capping strip lower down on the skirt 38.

Figure 2:
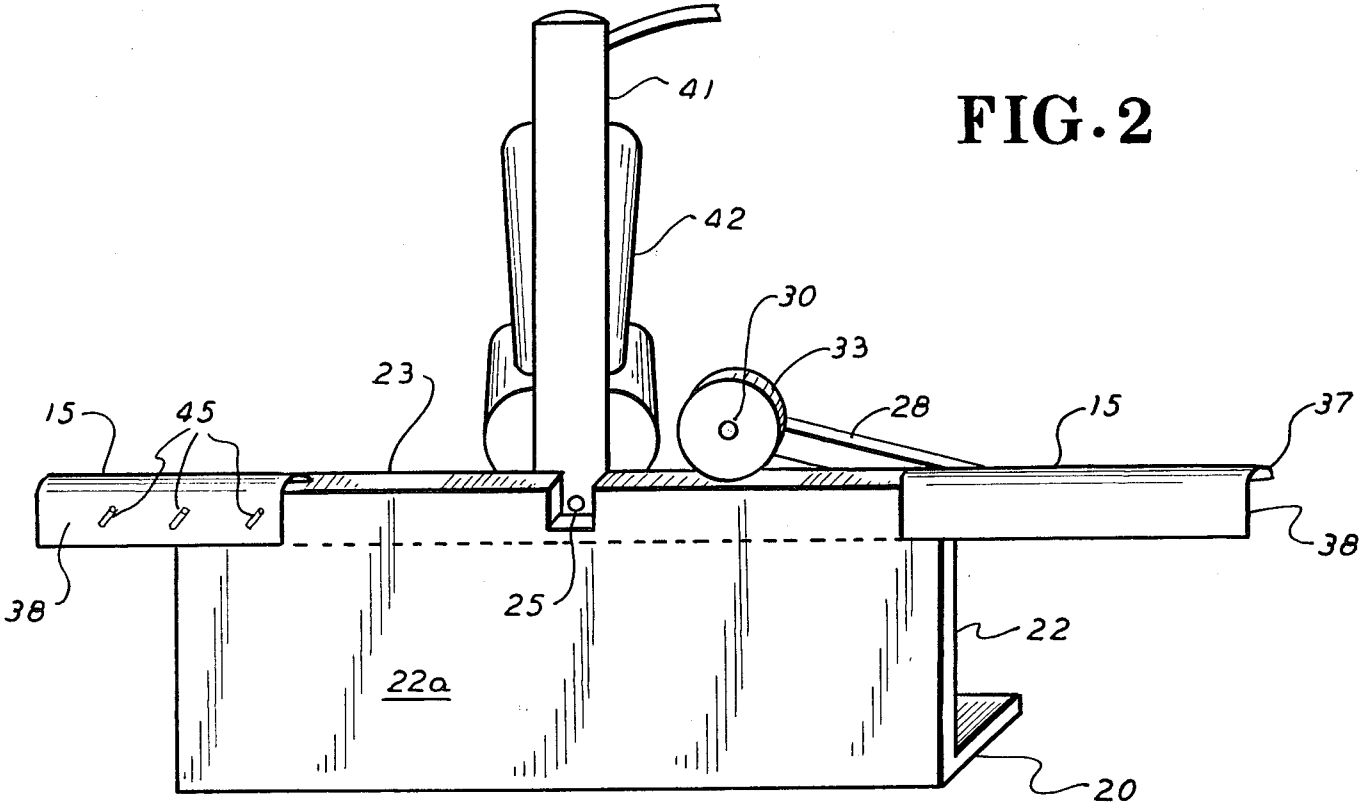
FIG. 2 is a representation, in perspective view of the representation of FIG. 1, as viewed from the wall side.
Figure 3:
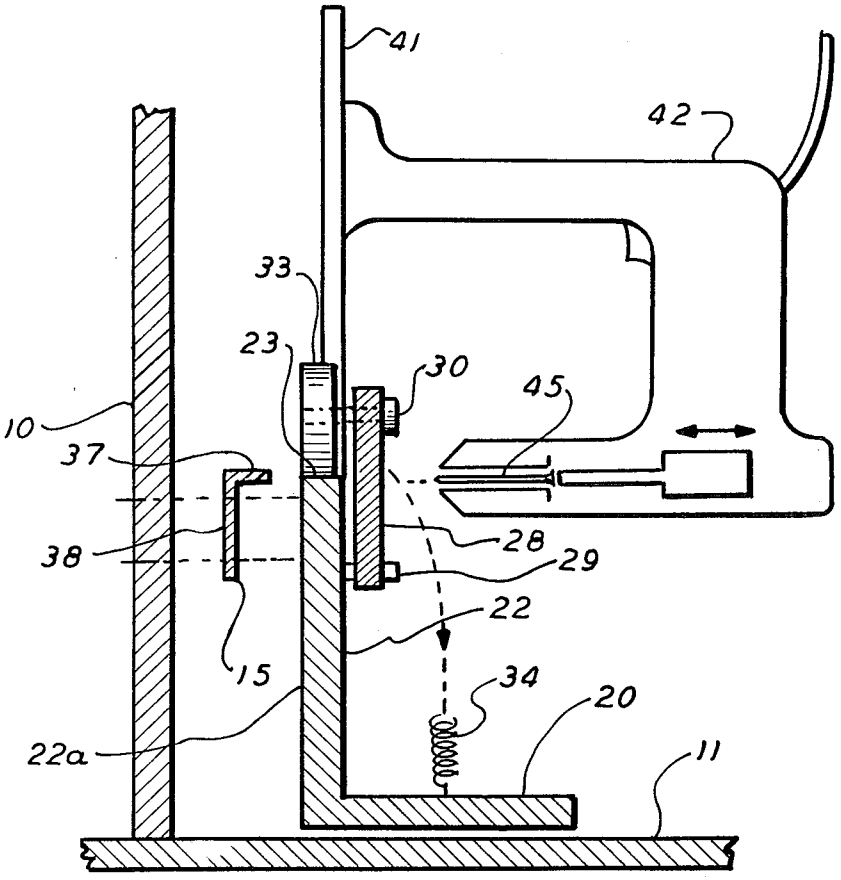
FIG. 3 is an exploded sectional view of the apparatus at work.

Although only one roller is provided in the preferred embodiment, a second roller may be mounted on the inside of the shoulder so as to ride on the top of the shoulder on the other side of the nailer from that shown in FIGS. 1 and 2. With two rollers the capped strip installing device could be operated in either direction, left or right, along a wall or other surface.

In a further embodiment of the invention, the base of the appliance may comprise a slider plate and a shoulder disposed at an angle to the slider plate. The shoulder extends from the slider plate to a top, spaced at an uniform distance from the plate. The shoulder has a pressing means, such as a roller, mounted on the shoulder and biased against the top of the shoulder.

It will be appreciated that the capping strip consists of a head or cap with a skirt extending from one end of the cap. The skirt of the capping strip is positioned against the wall and secured to the wall by the use of nails or staples or some other securing means used in well known manner. This holds the capping strip against the wall.

In using the invention, the appliance is positioned with the slider plate on the floor and the shoulder against the wall. The strip of capping material is positioned between the wall and the shoulder with the cap of the strip of material on the top of the shoulder and held or secured between the pressing means or roller and the top of the shoulder. The appliance is moved along the floor, against the wall and along the strip of capping material. As the appliance is moved along the strip of material, the strip of capping material is moved into position against the wall at an uniform distance from the floor. The strip of material may be secured to the wall using nails driven by a hammer or nailer or staples, driven by a staple gun, or other securing means separate from the strip positioning appliance.

A preferred embodiment of the invention and its preferred use has been shown and described. Several alternate embodiments and uses of the invention have also been discussed and/or suggested. Other changes and modifications may be made, as will become apparant to those skilled in the art, without departing from the spirit of the invention as defined in the appended claims.

What is claimed is:

1. Apparatus for fastening a strip of capping material on the surface of a wall at a uniform distance from a floor joining said wall, said apparatus including:

(a) a base positionable on said floor and against said wall and movable along said floor while against said wall said base including a substantially planar member for sliding said base along said floor and an upright shoulder connected to and extending from said planar member, said shoulder having a top extending along the length thereof at a uniform distance above said planar member;

(b) a roller mounted on said base and over said top of said shoulder and biased against said top of said shoulder at a point along the length of said shoulder;

(c) a port in said shoulder proximate said top; and (d) mounting means coupled said base for mounting a capping material fastening means to said base and aligned with said port for fastening said capping material to said wall through said port at a uniform distance above said floor.

2. Apparatus as in claim 1 and in which said wall and said floor form a predetermined angle at the place of joining and said planar member and said upright shoulder form another predetermined angle at the place of connection and said another predetermined angle approximates said predetermined angle.

3. Apparatus as in claim 1 and in which said planar member and said upright shoulder are connected at an angle.

4. Apparatus as in claim 3 and in which said connection between said planar member and said shoulder is fixed so that an angle formed at said connection is fixed.

5. Apparatus as in claim 3 and in which said connection between said planar member and said shoulder is adjustable so that an angle formed at said connection is adjustable.

6. Apparatus as in claim 1 and in which said fastening means is a nailer.

7. Apparatus as in claim 1 and in which said fastening means is a staple gun.

8. Apparatus as in claim 1 and in which said fastening means is an adhesive means that lays down a bead of adhesive on said wall and said strip of capping material for fastening said capping material to said wall.

9. A device for installing a strip of material on the surface of a wall at a uniform distance from a floor joining said wall and forming a predetermined angle between said floor and said wall, said device comprising:

(a) a base, said base including a slider and a shoulder, said slider and said shoulder joined at an angle approximating said predetermined angle, said slider for sliding said device along said floor;

(b) said shoulder including a face and a top, said face extending from the point of joining of said slider and said shoulder to said top, said face for sliding said device along said wall;

(c) a roller mounted on said shoulder and riding on said top for pressing said strip of material sliding along said top against said top as said strip material passes along said top;

(d) a port in said shoulder; and, (e) mounting means connected to said shoulder for mounting a strip material fastening means to said shoulder so that said fastening means is aligned with said port for fastening said strip of material to said wall through said port.

10. A device as in claim 9 and in which said slider and said shoulder are fixedly joined at said angle.

11. A device as in claim 9 and in which said slider is flat and is slid along said floor by an operator of said device.

12. A device as in claim 9 and in which said slider includes roller means and said slider is rolled along said floor by an operator of said device.

13. A device as in claim 9 and in which said slider and said shoulder are joined so that the angle formed at the junction of said slider and said shoulder is adjustable.

14. A device as in claim 9 and said roller is mounted on an arm extending from the inside face of said shoulder and said device further includes bias means coupled to said roller mount for pressing said roller against said top of said shoulder.

15. A device as in claim 9 and in which said strip material fastening means is a nailer.

16. A device as in claim 15 and said nailer drives nails into said strip of material through said port.

17. A device as in claim 9 and in which said strip material fastening means is a staple gun.

18. A device as in claim 17 and in which said staple gun drives a staple through said port and into said strip of material for installing said strip of material to said wall.

19. Apparatus for securing a stripe of material to a first surface at a uniform distance from a second surface joining said first surface at an angle, said apparatus comprising:

(a) a base including a first planar member and a second planar member joining each other at an angle substantially approximating the angle formed by said first surface and said second surface at the joining thereof;

(b) said first planar member positionable on said second surface for sliding said base along said second surface;

(c) said second planar member positionable along said first surface, said second planar member including a shoulder having a top, said top being a uniform distance along its length from the junction of said first planar member and said second planar member, a port in said second planar member proximate said top and mounting means for mounting a fastening means, said fastening means being mounted in alignment with said port for securing said strip of material to said first surface through said port.

20. Apparatus as in claim 19 and further including means mounted on said second planar means and pressing against said top of said shoulder for pressing said stripe of material against said top of said shoulder.

21. Apparatus as in claim 19 and in which said first planer member and said second planar member are joined so that the said angle formed at the junction thereof is adjustable.

22. Apparatus as in claim 19 and in which said means mounted on said second planar means is a roller.

23. Apparatus as in claim 19 and in which said first planar member includes a roller means mounted for rolling said base along said second surface.

24. Apparatus for installing a strip of material on the surface of a wall at a uniform distance from a floor joining said wall and forming an angle at the junction of said wall and said floor, said apparatus comprising:

(a) a slider plate for sliding said apparatus along said floor;

(b) a shoulder joined to said slider plate and forming an angle at the junction of said slider plate and said shoulder approximating the angle formed at the junction of said wall and said floor, said shoulder having a surface for sliding along said wall as said slider plate slides along said floor, said surface of said shoulder extending to a top, said top having length and being uniform in distance from said slider plate along substantially the entire said length; and, (c) pressure exerting means coupled to said shoulder and resting on said top for pressing against said top of said shoulder for holding at least a portion of said strip against said top.

25. Apparatus as in claim 24 and in which said pressure exerting means is a roller mounted on an arm and said arm is mounted on said shoulder, said roller positioned over said top and further including biasing means coupled to said roller for pressing said roller against said top.

26. Apparatus as in claim 24 and in which said slider plate includes roller means coupled to said slider plate for rolling said apparatus along said floor.

27. Apparatus as in claim 24 and further including means for securing said strip of material to said wall as said apparatus moves along said strip of material, along said floor and along said wall.

28. Apparatus as in claim 27 and in which said means for securing said strip of material to said wall is mounted on said apparatus.

* * * * *